US006718589B2

(12) United States Patent
Kimbro

(10) Patent No.: US 6,718,589 B2
(45) Date of Patent: Apr. 13, 2004

(54) SPRING ACTIVATED PUSH BROOM

(76) Inventor: Chris R. Kimbro, 2009 Morgan La., Suite B, Redondo Beach, CA (US) 90278

( * ) Notice: Subject to any disclaimer, the term of this patent is extended or adjusted under 35 U.S.C. 154(b) by 102 days.

(21) Appl. No.: 09/975,208

(22) Filed: Oct. 12, 2001

(65) Prior Publication Data

US 2002/0092107 A1 Jul. 18, 2002

Related U.S. Application Data

(60) Provisional application No. 60/261,786, filed on Jan. 17, 2001.

(51) Int. Cl.[7] ..... A47L 13/00; A46B 3/00; A46B 15/00

(52) U.S. Cl. ..... 15/159.1; 15/143.1; 15/144.1; 15/144.3; 403/109.2; 403/109.3

(58) Field of Search ..... 15/143.1, 144.1, 15/172, 159.1, 160; 403/109.1–109.3, 377, 378, 166

(56) References Cited

U.S. PATENT DOCUMENTS 750,357 A * 1/1904 Gibbons ..... 15/160
1,505,318 A * 8/1924 Berlow ..... 403/205
1,663,208 A * 3/1928 Mayer ..... 15/143.1
1,977,180 A * 10/1934 Forbes ..... 403/100
1,982,910 A * 12/1934 Forbes et al. ..... 403/100
2,980,457 A * 4/1961 Page ..... 15/245
4,180,346 A * 12/1979 Blake ..... 403/109.3
5,384,930 A * 1/1995 Uno ..... 15/159.1
6,279,961 B1 * 8/2001 Stoltz ..... 285/7
6,546,588 B1 * 4/2003 Black ..... 15/244.1

* cited by examiner

*Primary Examiner*—Terrence R. Till
*Assistant Examiner*—Laura Cole
(74) *Attorney, Agent, or Firm*—Roger A. Marrs

(57) ABSTRACT

A push broom having an extendable handle with an upper section slidably mounting a lower section with a compressible coil spring mounted therebetween for urging the lower section forward or away from the upper section. The lower section includes a bristle brush with an attachment fitting for threadably coupling with the lower section. Bushings carried on both the upper section and the lower section permit a smooth sliding relationship between the sections. A protective boot of the bellows type has opposite ends secured to the upper section and the lower section respectively and encloses the compressible coil spring.

3 Claims, 2 Drawing Sheets

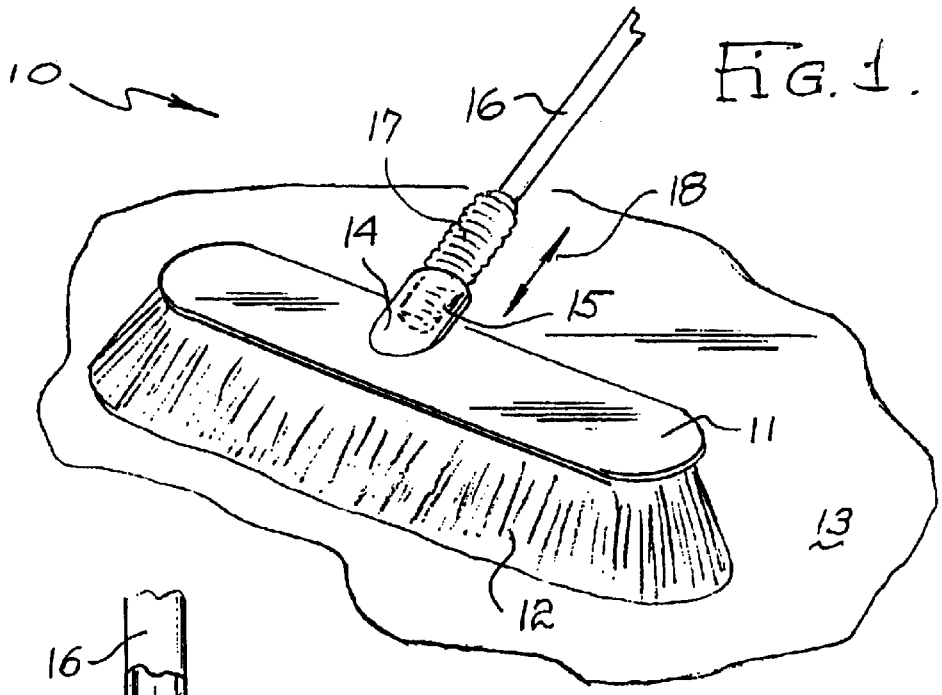
FIG. 1.
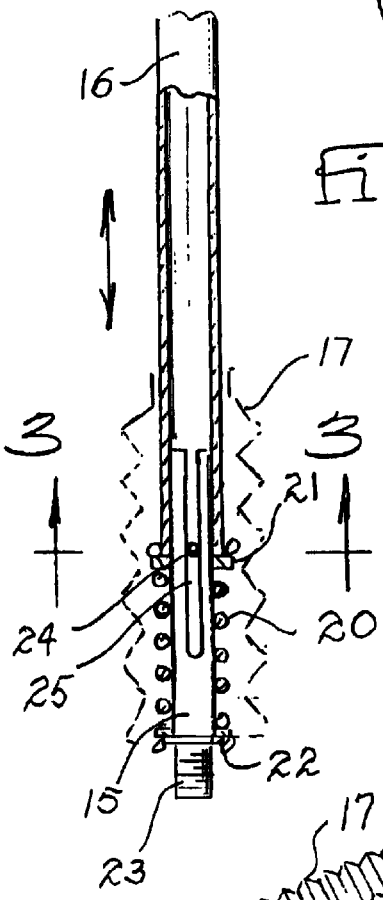
FIG. 2.
FIG. 3.
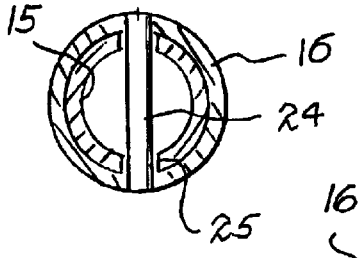
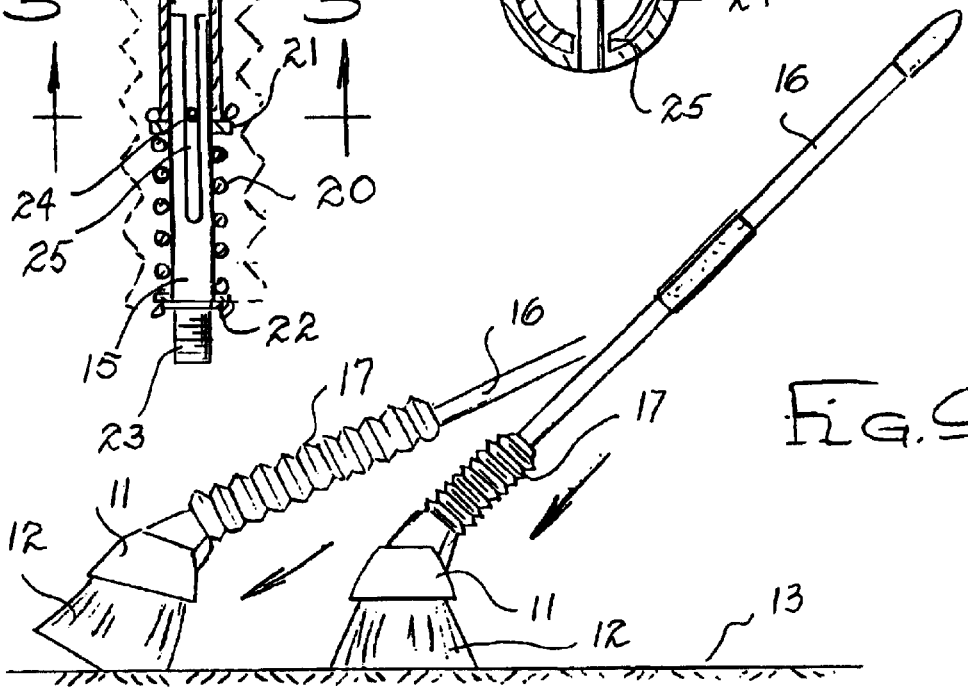
FIG. 4.

SPRING ACTIVATED PUSH BROOM

Priority Claimed on Ser. No. 60/261,786 filed Jan. 17, 2001.

BACKGROUND OF THE INVENTION

1. Field of the Invention

The present invention relates to the field of push brooms or manual sweepers and more particularly to a novel push broom or sweeper having a spring means compressible between a pair of handle sections adapted to normally expand to forcibly urge one of the sections carrying a brush or broom forward in engagement with a floor or surface intended to be swept.

2. Brief Description of the Prior Art

In the past, it has been the conventional practice to employ a manual push broom or sweeper which engages a floor surface for the purpose of gathering or collecting dirt, dust, or debris. The length of stroke for a sweep is limited to the length of the handle and/or the hand gripping by the user. For this reason, for a given surface area, multiple sweeping strokes are necessary in order to rid the surface of dirt, dust or debris. Also, problems and difficulties have been encountered when using conventional push brooms or sweepers which stem largely from the fact that a certain force is needed in order to maintain a good brushing engagement between the bristles of the brush or sweeper and the floor surface intended to be swept. Such a force is generally applied directly by the user through the handle to the bristles of the brush. For this reason, the handle and the bristles of the brush which are normally carried on a brush head or body are rigid and represent a solid, continuous load bearing structure through the handle into the brush head and consequently into the bristles themselves. There is no flexibility in the handle as this would add to the problem of load transmission.

Therefore, a long-standing need has existed to provide a manual push broom or sweeper which includes a resilient means in the handle for exerting a forceful load to the bristles of the brush or sweeper in addition to the manual effort needed to push the brush. Also, such means should provide for automatically extending the length of the broom or sweeper handle so that the length of sweeping stroke can be increased from that of a conventional push broom or sweeper.

SUMMARY OF THE INVENTION

Accordingly, the above problems and difficulties are avoided by the present invention which provides a novel push broom or sweeper having a plurality of bristles which are secured to the underside of a brush head or body. The broom further includes an elongated handle having one end connected to the body of the broom and the opposite end readily available for gripping by the user in order to perform sweeping strokes across a floor surface or the like. A feature of the invention resides in providing the handle and two telescoping related sections having a compression spring mounted therebetween which normally expands to force one section away from the other in order to extend the linear length of the handle. The compression spring is compressed upon engagement of the bristle with the floor intended to be swept and when the force on the handle is relaxed by the user, the spring expands to force the section of the handle outwardly so as to apply an automatic force to the bristles for engaging with the surface of the floor. A guide means is provided between the two sections so that linear movement between the sections is assured and a collapsible or flexible boot covers the compression spring and the guide means by having the opposite ends of the boot secured respectively to each of the sections. Also, bushing means are provided between the sliding portions of the sections and such bushings are adapted to mount the opposite ends of the compression spring whereby one end of the spring is attached to one section and the other end of the spring is attached to the other section. Therefore, as the push broom is pushed forward, the spring will compress due to the pressure of the bristles against the floor surface causing the sections to be drawn together while the normal tendency of the spring to expand provides a load force to the bristles for the sweeping action. Upon conclusion of a sweeping stroke, the user relaxes the pushing force which allows the compression spring to expand forcibly urging the bristles to automatically advance forward for a limited distance preparatory for the next sweeping stroke.

Therefore, it is among the primary objects of the present invention to provide a novel push broom or manual sweeper which includes means for automatically advancing the bristles of the broom forward preparatory for a sweeping stroke and which will automatically provide a force to the bristles for engaging the sweeping surface during the progress of the sweeping stroke.

Another object of the present invention is to provide a novel push broom or sweeper which includes automatic means for advancing or extending the length of the handle of a push broom by means of spring expansion and for automatically applying a force between the bristles and the surface to be swept when the spring expands during a sweeping procedure.

Yet another object of the present invention is to provide a two section handle for a push broom having a pair of telescoping sections which are connected together by means of a compression spring and which is covered by a protective expandable boot.

A further object resides in providing a push broom which conserves the energy of the user by employing a compression spring in the handle of the broom.

Still a further object of the invention resides in providing a spring-loaded handle for a push broom which serves as a cushion to the user during a sweeping operation and which does not require a full-arms reach in order to properly sweep the surface of a floor.

A further object incorporated into the invention resides in providing a spring-loaded handle for a push broom having a rotating pin in an outer and upper section of the handle and which further includes a groove in a bushing serving as a detente means for maintaining the handle sections in alignment for linear sliding movement therebetween.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view illustrating a push broom incorporating the present invention;

FIG. 2 is a fragmentary, sectional view of the handle used in the broom shown in FIG. 1 illustrating the pair of sections connected together by the compression spring;

FIG. 3 is a transverse, cross-sectional view of the handle shown in FIG. 2 as taken in the direction of arrow 3—3 thereof;

FIG. 4 is a diagrammatic side elevational view of the push broom illustrating the compression spring compressed at the beginning of a sweeping procedure and also illustrating the bristles of the brush at the end of a sweeping stroke with the compression spring expanded;

DESCRIPTION OF PREFERRED EMBODIMENT

Figure 5:
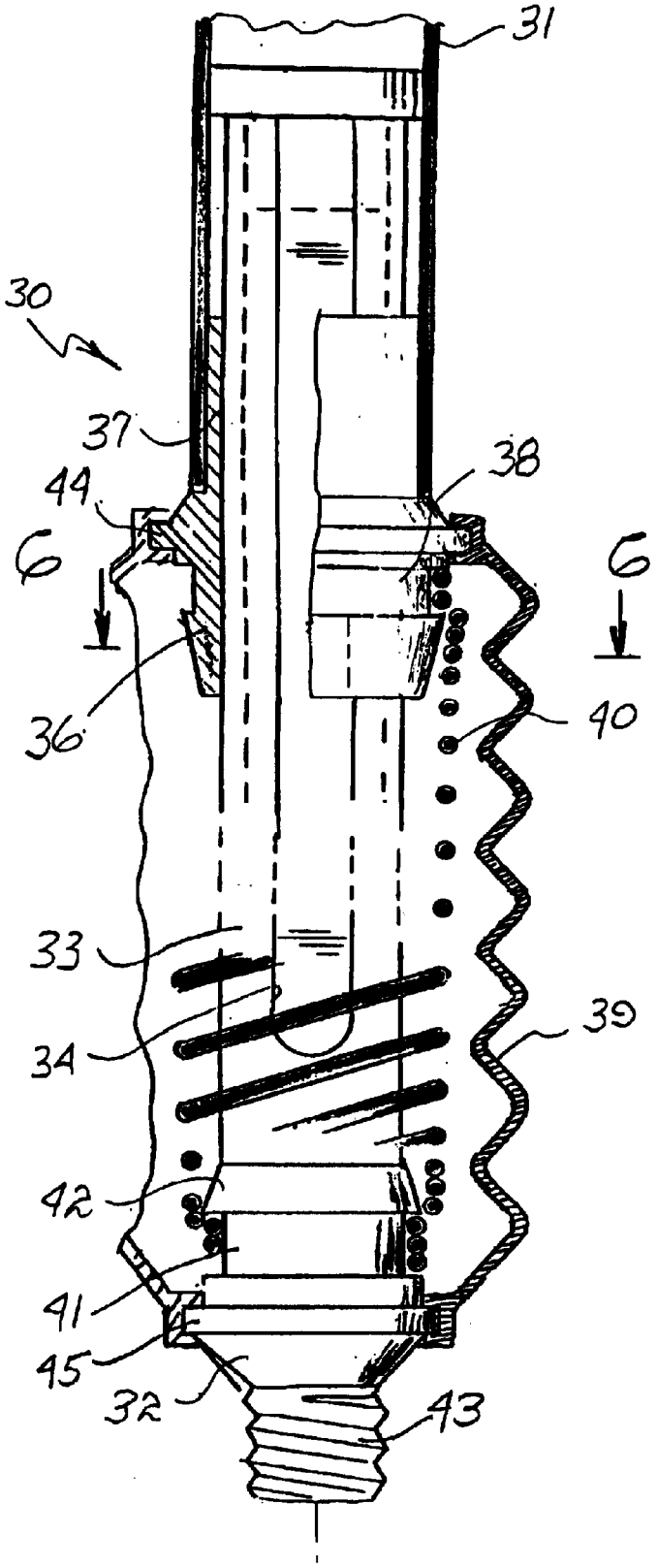
FIG. 5 is a longitudinal, cross-sectional view of another embodiment or version of the present invention.

Referring to FIG. 1, the novel push broom or sweeper is indicated in the general direction of arrow 10 which includes a brush head or body 11 having a plurality of bristles downwardly depending therefrom as represented selectively by numeral 12. The ends of the bristles are in engagement with the surface 13 of a floor intended to be swept by collecting dirt, dust, or debris ahead of and in the bristles 12. The head or body 11 includes a socket 14 for receiving a handle which comprises a pair of linear sections 15 and 16 which are arranged in telescoping, sliding relationship. The junction of the adjacent ends of the sections 15 and 16 are covered by a flexible protective boot 17. Linear movement between the two sections is indicated by the double headed arrow 18.

Referring now in detail to FIG. 2, it can be seen that the section 16 of the handle represents an outer sleeve or section while the section 15 is inserted through the open end of the section 16 and is in sliding relationship therewith. The sections are held together by means of a compression spring 20 having the opposite ends of the spring coupled over flanges 21 and 22. The extreme end of section 15 terminates in a threaded stud 23 for threadable engagement with the thread of socket 14. A pin 24 carried on the handle section 16 slides within a slot 25 provided in the end of section 15 and the pin and slot serve as a guide means for maintaining movement between the sections in a linear direction. The sections cannot rotate with respect to one another because of the guide means. In normal storage condition when the broom is not in use, the spring 20 expands outwardly. However when the user places pressure on the handle to forcibly urge the bristles forward during a sweeping stroke, the spring 20 will compress but serves as a cushion so that the user does not have to apply full arm's strength to the sweep. The normal expansion of the spring will assist the user by forcibly urging the bristles forward so that a substantial load from the spring is added to the arm force of the user.

In FIG. 3, it can be seen that the pin 24 is within the slot 25 so that the sections 15 and 16 cannot rotate. Also, it can be seen that the sections are in sliding, telescopic relationship and that the section 15 is on the inside of the tubular section 16.

Referring now in detail to FIG. 4, it can be seen that when the user applies downward pressure on the handle 16, the spring 20 will compress and the compression will be followed by compression of the flexible boot 17. The applied force of the user's arm is conducted through the section 15 into the brush head 11 and the bristle 12 respectively. The user then commences a sweeping stroke and as the stroke is lengthened to the second position shown in FIG. 4, the spring 20 expands as well as the boot 17 which forces the brush head 11 and the bristle 12 even further than could be achieved by the single arm stroke of the user. Therefore, the length of sweep is greatly increased and the force for sweeping during the stroke is achieved not only by the arms of the user but the expansion of spring 20 and its intended force.

Referring to FIG. 5, another embodiment of the present invention is illustrated in which the handle comprises a lower section 32 which moves in a reciprocal linear manner to and from the end of upper handle section 31. The lower section 32 includes an elongated portion 33 which is insertably received within the bore of tubular upper handle section 31. The portion 33 includes an elongated slot or groove 34 which is part of the guide means and also prevents rotation between the sections. Into the slot 34, there is inserted a key 35, shown more clearly in FIG. 6, which downwardly depends from a bushing and spring locking mechanism 36. The bushing and mechanism 36 is attached to the end of upper section 31 and includes a bore 37 in which the portion 33 of the lower section 15 slides. The bushing 36 also includes a connection groove 38 for retaining the end of a compression spring 40. The opposite end of the spring is secured within a groove 41 in a fixture 42. The lower section 32 terminates in a threaded stub 43 for threadable engagement with the threaded socket 14 of the brush head 11.

The compression spring 40 is enclosed by an expandable or flexible boot 39 having its opposite end secured to a flange 44 carried on bushing 36 and the other end connected to a flange 45 carried on the fixture 42.

Figure 7:
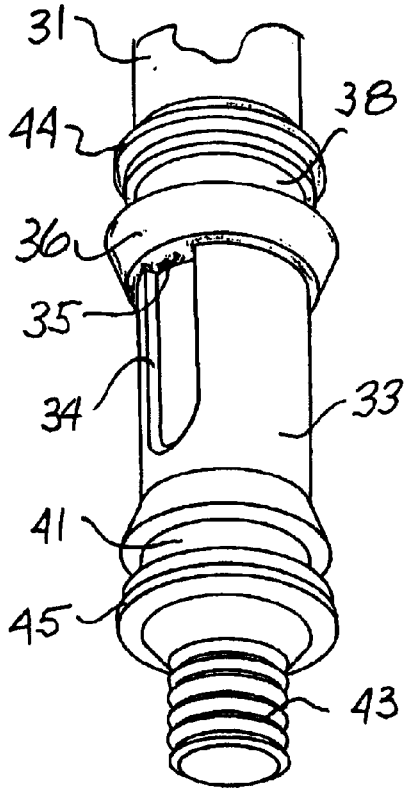
FIG. 7 is a front perspective view illustrating the bushings and guide slots used in the embodiment shown in FIG. 5.

Referring now in detail to FIG. 7, the insert of key 35 into the slot 34 on portion 33 is more clearly seen as well as the retention grooves 38 and 41 for holding the opposite end of the expansion spring 40.

Figure 6:
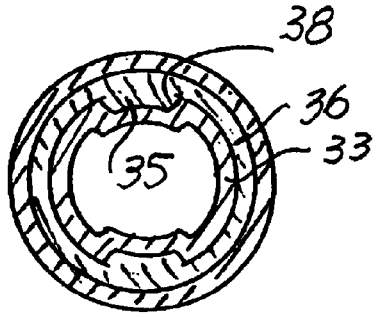
FIG. 6 is a transverse, cross-sectional view of the version shown in FIG. 5 as taken in the direction of 6—6 thereof.

In FIG. 6, rotation between the handle sections is prevented by means of the key 35 within the slot or keyway 38. A pair of keys and keyways are provided so that only rectilinear movement between the handle sections is prevented.

In view of the foregoing, it can be seen that the inventive push broom or sweeper of the present invention combines a compression spring located in the handle adjacent to where the handle attaches to the broom head. The handle is composed of an inner sleeve or section which connects to a lower section in telescoping relationship so that the respective sections can slide with respect to each other. When connecting the two sections together, a compression spring is employed having opposite ends connected to each of the respective sections which allows the sections to expand with respect to one another when there is no load placed on the handle or at least a partial load. The guide or detente means prevents the handles from rotating and maintains the sections on the same axis and allows them to slide in and out of each other. When the spring compresses in the handle, the user feels a much softer and smoother motion during the sweeping procedure. Current push brooms consume a great deal of energy from the user. A full arms reach, which was or is required by traditional push brooms, is greatly reduced by the use of the current invention. The user need only apply half the energy as compared to conventional brooms in order to sweep a floor.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A push broom comprising:

a bristle brush;

an elongated handle secured to said bristle brush;

said handle having a pair of sections arranged in sliding telescoping relationship located adjacent said bristle brush;

a compression spring mounted between said sections normally expandable to forcibly urge said bristle brush into engagement with a floor surface;

detente means operably interconnecting said sections to prevent rotation therebetween;

guide means movably coupling said sections together to provide rectilinear movement between said sections;

said sections having opposite ends engaged in sliding connection;

a selected section having a pin or key and a non-selected section having a slot or keyway for accepting said pin or said key;

a flexible boot having opposite ends secured to said sections respectively and covering said compression spring;

said boot is a bellows having a mid-section consisting of a plurality of convolutions;

a bushing interposed between said sections and secured to one end of said boot and one end of said spring; and a fitting secured on a selected one of said sections for securement with the other ends of said boot and said spring respectively.

2. An implement for engaging a surface to be cleaned comprising:

an elongated handle;

a cleaning device secured to said handle;

said handle having an upper section and a lower section;

adjacent ends of said upper section and said lower section arranged in slidable telescoping relationship permitting rectilinear movement with respect to each other;

resilient means carried on said adjacent ends in securement with said upper section and said lower section and normally urging said lower section away from said upper section;

said lower section connected with said cleaning implement;

a key and keyway arrangement carried on said adjacent ends for providing guiding movement of said lower section with respect to said upper section in said rectilinear movement;

said key and keyway arrangement preventing rotation of said upper section with respect to said lower section;

said resilient means is a compressible coil spring normally expanded to extend overall length of said handle by forcibly urging said lower section away from said upper section;

said lower section having an extended portion insertably receivable in said upper section and terminating with a bushing in slidable relationship with said upper section;

a combined bushing and spring locking mechanism secured to said upper section and having a base for slidably receiving said extended portion;

said compressible coil spring has two ends;

one end of said compressible coil spring is secured to said combined bushing and spring locking mechanism and the other end secured to said lower section; and a bellows boot enclosing said compressible coil spring and having opposite ends secured to said upper section and said lower section respectively.

3. In a push broom apparatus having an elongated handle with a brush attached to one end thereof, the improvement which comprises:

said handle having an upper section of tubular construction and having a lower section insertably received in said upper section in slidable relationship therewith;

a compression coil spring disposed about said lower section and having opposite ends secured to said upper section and said lower section respectively permitting controlled movement therebetween to normally extend said lower section away from said upper section so as to extend the overall length of said handle;

a bellows boot enclosed said compression coil spring and having a pair of opposite ends secured to said upper section and secured to said lower end respectively;

a first bushing carried on said lower section in sliding relationship with said upper section;

a second bushing carried on said upper section in sliding relationship to said lower section; and securement means for holding one end of said compressible coil spring to said second bushing and for holding another end of said compressible coil spring to said lower section.

* * * * *